US005636900A

United States Patent [19]

Wilkie et al.

[11] Patent Number: 5,636,900

[45] Date of Patent: Jun. 10, 1997

[54] ADJUSTABLE SEATING SYSTEM

[75] Inventors: David C. Wilkie, St. Paul, Minn.; Wayne Rydberg, River Falls; Bruce Tew, Clayton, both of Wis.; Rob Meyer, Stacy; John Spielman, Maplewood, both of Minn.

[73] Assignee: Gillette Children's Hospital, New Brighton, Minn.

[21] Appl. No.: 388,240

[22] Filed: Feb. 14, 1995

[51] Int. Cl.[6] ..... A47C 7/50

[52] U.S. Cl. ..... 297/423.19; 297/344.12; 297/353; 297/284.3; 297/384.9; 297/467; 297/DIG. 6; 297/452.48; 297/440.14

[58] Field of Search ..... 297/452.37, DIG. 1, 297/467, 423.2, 423.23, 423.17, 344.14, 344.13, 344.12, 353, 284.3, 440.14, 440.22, 337, DIG. 6

[56] References Cited

U.S. PATENT DOCUMENTS

| | | | |
|---|---|---|---|
| 2,549,902 | 4/1951 | Hibbard et al. | 297/284.3 |
| 2,968,338 | 1/1961 | Reese | 297/23.25 X |
| 3,761,126 | 9/1973 | Mulholland | 297/411.37 X |
| 3,814,476 | 6/1974 | Abbott | 297/344.14 X |
| 4,138,750 | 2/1979 | Michalowski . | |
| 4,300,249 | 11/1981 | Taylor | 297/423.17 X |
| 4,453,766 | 6/1984 | DiVito . | |
| 4,603,903 | 8/1986 | Moscovitch | 297/440.22 X |
| 4,617,919 | 10/1986 | Suhre . | |
| 4,640,546 | 2/1987 | Aguilar . | |
| 4,647,066 | 3/1987 | Walton | 297/DIG. 4 X |
| 4,732,423 | 3/1988 | Condon | 297/DIG. 4 X |
| 4,793,652 | 12/1988 | Hannah et al. | 297/DIG. 4 X |
| 5,097,542 | 3/1992 | Roesler . | |
| 5,110,183 | 5/1992 | Jeanes, III . | |
| 5,116,067 | 5/1992 | Johnson . | |
| 5,161,812 | 11/1992 | DeWeese . | |
| 5,301,968 | 4/1994 | Ward et al. . | |
| 5,320,416 | 6/1994 | Kornberg | 297/DIG. 4 X |
| 5,358,263 | 10/1994 | Aldus et al. . | |
| 5,366,277 | 11/1994 | Tremblay | 297/440.14 X |

FOREIGN PATENT DOCUMENTS

| | | | |
|---|---|---|---|
| 681131 | 1/1965 | Italy | 297/344.14 |

*Primary Examiner*—Milton Nelson, Jr.

*Attorney, Agent, or Firm*—Merchant, Gould, Smith, Edell, Welter & Schmidt, P.A.

[57] ABSTRACT

The adjustable seating system includes a seat and a stand for people with disabilities. The seat has a base with two side panels and a back positioned adjacent the seat base. The seat back has first and second opposing thorasic supports. The seat base also includes a base extension which may be fitted into the seat base. The seating system may also include a foot support which maybe attached to the seat base extension. The seating system also includes an adjustable stand. In operation, the base extension may be attached to the seat by aligning the seat and the base extension and inserting pins which join the base extension and seat. Optionally, the seating system may have a back extension releasably attached to the seat back. The seating system may also have a cushion system to provide comfort and support to the user as well as in providing assistance positioning and posturing.

16 Claims, 6 Drawing Sheets

ADJUSTABLE SEATING SYSTEM

FIELD OF THE INVENTION

The invention relates generally to facilities such as adjustable restraints and supports. More specifically, the invention relates to disability supports and restraints which are adjustable to meet the needs of individuals as they grow or to aid in the positioning and added comfort of the individual.

BACKGROUND OF THE INVENTION

Facilities such as restraints and supports useful in hospital, health care, and home care settings are well known in the art. Such facilities are used to enhance and ease the lives of those individuals who may not be able to carry on normal or routine daily activities. These types of facilities have been used for assisting people with disabilities in mobility and transport, routine daily activities, and normal bodily functions.

Several exemplary devises include Michalowski, U.S. Pat. No. 4,138,750 which discloses a sling chair for transporting disabled persons. Roesler, U.S. Pat. No. 5,097,542 discloses a chair that will fit inside a bathtub or shower stall which is held in place by suction cups affixed to the wall of the shower or bath.

Aguilar, U.S. Pat. No. 4,640,546 discloses a rocker recliner chair which has been adapted to rock or pivot between a forward stable position to a rearward unstable position. Aldus et al, U.S. Pat. No. 5,358,263 discloses a travel-air chair which is essentially a wheelchair capable of being folded into a compact size for storage and a hanging wardrobe or overhead storage of an aircraft.

Johnson, U.S. Pat. No. 5,116,067 discloses a convertible chair support for a person with a disability. The support structure is adapted so that it can be attached to the standard wheelchair wheels for providing mobility to disabled persons while allowing for the interchanging of accessories useful in various activities such as sporting activities like water skiing, snow skiing and the like.

Suhre, U.S. Pat. No. 4,617,919 discloses a wheelchair with posture supports for adjustably supporting the neck, thoracic cavity, and thighs. DeWeese, U.S. Pat. No. 5,161,812 discloses a travel-lift chair which has an adjustable seat that may be raised or lowered by a hand-powered hydraulic ram. Jeanes, U.S. Pat. No. 5,110,183 discloses a customized home chair which reclines to meet the requirements of the occupant. DiVito, U.S. Pat. No. 4,453,766 discloses a lift chair for people with disabilities which has a rotatable seat and moveable back.

While many of these inventions provide features necessary and helpful to overcome problems suffered by people with disabilities, there is a definite need for supports, restraints which are comfortable, easily adjustable, and easily maintained over the longer term. Specifically, individuals who are born with disabilities or become disabled at a very early age generally require supports or restraints for the balance of their life. As the individual grows, the guardian is presented with the dilemma of purchasing newer, larger restraint and support systems on a regular basis. Further, in many instances the individual's need for restraint or support is immediate and missizing of the support or seat, caused for example by patient growth, cannot be tolerated. For example, in many individuals with cerebral palsy, spinal support is an absolute necessity to provide for correct skeletal support and to avoid the occlusion of the cardiovascular system. The result of this dilemma is that a support such as a seating system must be replaced or adjusted regularly to allow for proper fitting of a growing person with a disability.

As an alternative, adjustable support or restraint systems may be used. However, as with many health care technologies, adjustment of any device can often be complex requiring the assistance of a professional or additional special tooling. This can be terribly inconvenient and expensive, especially in circumstances where the individual with a disability lives in an area located any distance from a health care facility.

As a result, there is a need for adjustable restraints and assists which may be easily maintained in any number of environments through the simple manipulation of the device.

SUMMARY OF THE INVENTION

In accordance with a first aspect of the invention, there is provided an adjustable disability seating system comprising a base, a back positioned adjacent the base, and a base extension releasably fitted to the seat.

In accordance with a more preferred aspect of the claimed invention, there is provided an adjustable disability seating system comprising a seat and stand, the seat comprising a base having two side panels, each of which has an opening, a back positioned adjacent the seat base and having first and second opposing thoracic supports, a base extension having two sides, each of which has a series of slots designed to allow attachment of the base extension to the seat base, a foot support attached to said base extension, a cushion system, and a stand with an adjustable cradle.

The invention is a seating system which is easily adjusted in vertical, lateral, and horizontal dimension to allow for the specific needs of the user. The invention combines the use of cushions bolsters and various components parts assembled through rails and tracks to provide a restraint or support system which may be enlarged or reduced in dimension. Adjustment of the seating system of the invention may be undertaken by the addition of an extension to the seat back, extending the seat base or through the manipulation of a series of cushions in the pelvic, hip torso, and thoracic regions of the chair. Through these various mechanisms, the seating system can be selectively enlarged or reduced to provide variable and substantial support to the specific areas of the user's anatomy.

The invention is designed to allow for adjustment by the patient's guardian or any other individual having a low level of skill in the area of therapeutic physical support. Additionally, the invention is designed to allow for adjustment without the use of complex machinery or tooling. It is a self-contained unit which can stand alone or work in conjunction with most commercially available wheelchairs and strollers.

DETAILED DESCRIPTION OF THE PREFERRED EMBODIMENTS

Figure 1:
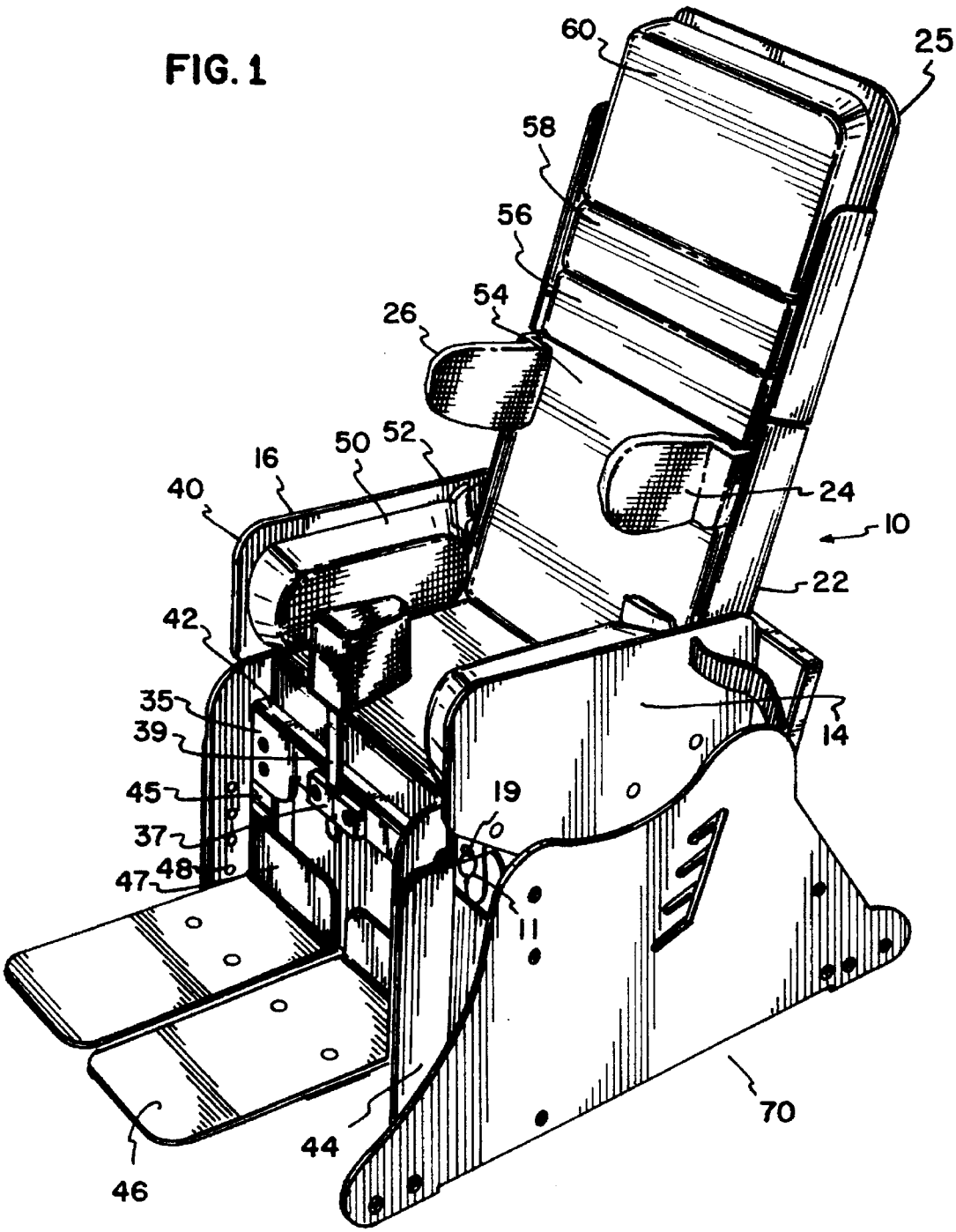
FIG. 1 is a perspective view of an adjustable seating system in accordance with one embodiment of the invention.
Figure 2:
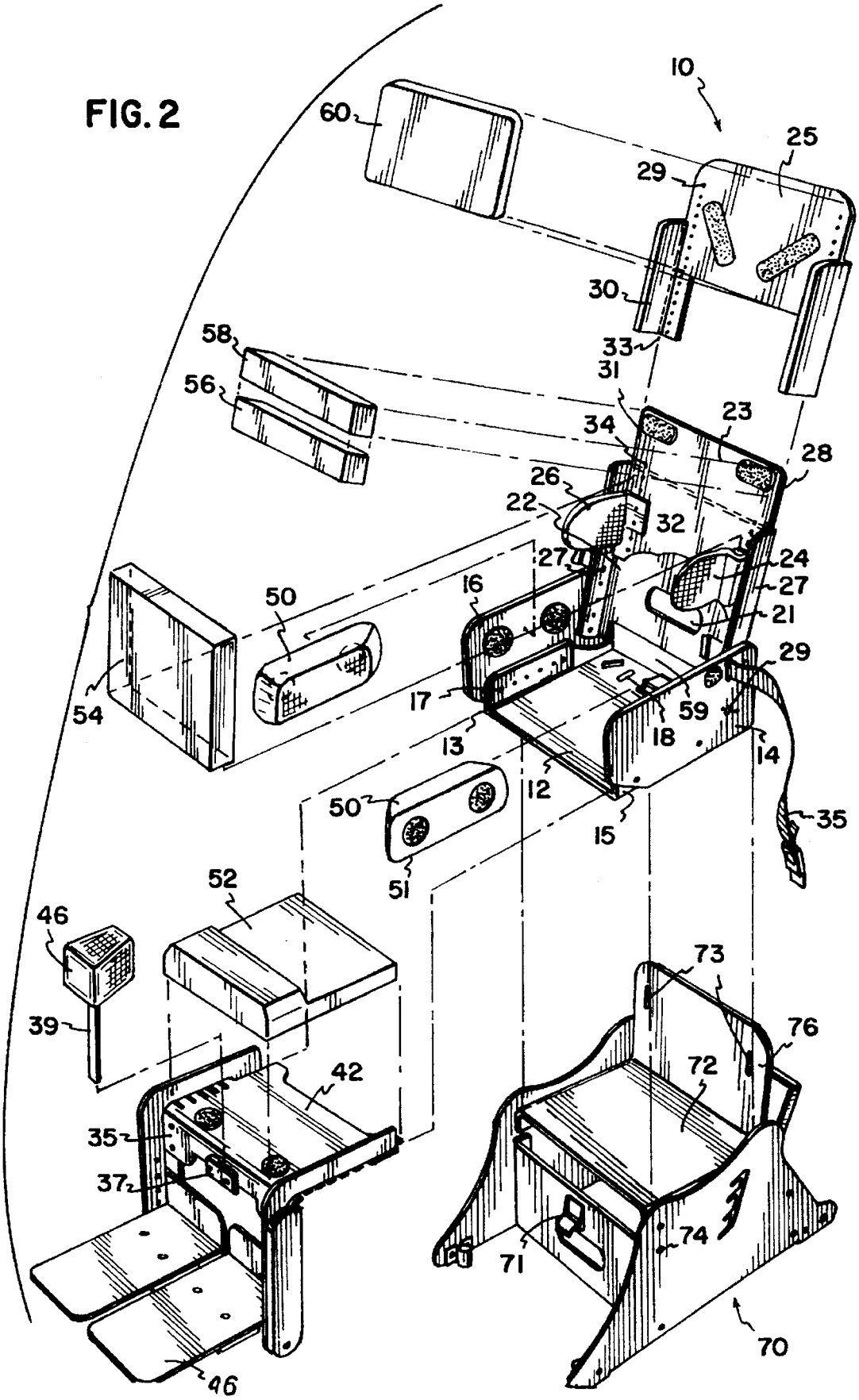
FIG. 2 is an exploded perspective view of the seating system shown in FIG. 1.

Turning to FIGS. 1 and 2, wherein like parts and features are designated with like numerals throughout several views, there is shown an adjustable seating system comprising a seat 10 and a stand 70. The seat has a base 12 which is attached to first and second side panels 14 and 16, respectively. The seat base 12 has supporting flanges, 15 in 17 on either side which support the first and second side panels 14 and 16 and include one or more holes 19 (FIG. 1) for the insertion of means 11 such as for "11 bolt", etc. to secure the base extension in the desired position in relationship to the seat base 12. The seat also has a back 22 positioned adjacent the set base 12. The seat back has attached thereto first and second opposing torso supports 24 and 26 respectively.

The seat back 22 may be extended vertically through back extension 28 and head support 30. The seat back extension 28, head support and thoracic supports, 24 and 26, may be affixed to each other through the use of holes or openings as well as screws, pins, or bolts. The elements of the seat back may comprise any number of drilled, fitted, or threaded openings or holes 29 patterned to allow for both vertical and lateral adjustment. The elements of the seat back 22 may be slid together through edges or rails 31 and track 33. The various elements which may be slid into complementary tracks 33 on the elements may then be joined, secured or attached through the holes and screws 34, FIG. 2.

Figure 4:
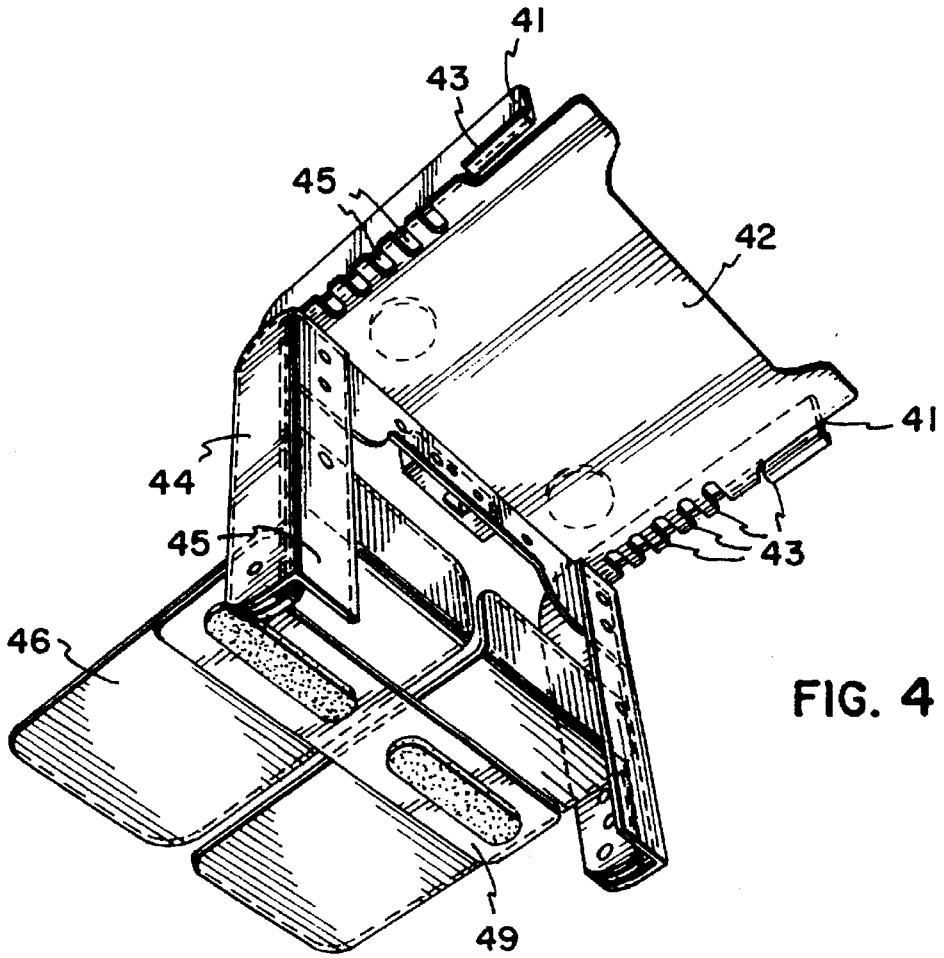
FIG. 4 is an view of a seat base side panel cushion in accordance with one embodiment of the invention.

Similarly, base extension 42 may be slid into the seat base 12 and fitted or attached to the base 12 by aligning the slots 45 on the base extension 42 to the corresponding openings 19 on either side of the seat base 12, (FIGS. 1 and 4). The seat 10 may also have a pommel 40 held to the extension by means such as rod 39 and bracket 37. The base extension 42 may have arms 44 which project substantially vertically to join foot support 46. Here again, foot support 46 may be attached between arms 44 by a rail and track assembly into which foot support arms 47 are fitted and secured by means such as holes 48 and screws, bolts, or releasable pins.

The seating system of the invention may also have an assortment of modular bolsters or cushions such as 50, 52, 54, 56, 58, and 60 (FIG. 1) attached to various areas of the system seat to provide comfort, support, and assistance in positioning the occupant.

The seating system of the invention also has a stand 70, FIG. 1. The stand contains an adjustable cradle 72 which has a back 76 and a seat 74. Preferably, the cradle 72 is adjustable in relationship to the stand 70 through a positive locking mechanism 80 (FIG. 6) which includes patterned opening 82, spring 84, rod 86 and lock release mechanism 88, FIG. 5. The stand 70 may comprise any number of added belting and clasp "mechanism as well as mobility aids.

The seating system of the invention generally functions to provide the user with comfort and support as well as providing the required therapeutic action in assisting posture and physical activity. The seating system of the invention may also be used to increase the mobility of individuals who are otherwise unable to complete, participate in, or otherwise undertake daily activities. Additionally, the seating system of the invention provides support to the individual using the seating system while retaining a level of adjustability allowing for the seat to essentially "grow" with its primary user.

To this end, the seating system may undertake any number of variations or designs within these functions. In use, the seating system is preferably a modular, lightweight system having any number of handles and straps to assist the user and/or guardian. Generally, the seating system may be composed of any number of polymeric, metal or metal alloy, or composite materials which will provide economic affordability, reduced weight or mass, and aid in the modular aspects and mobility of the device.

Polymeric compositions which may be useful in accordance with the invention include those made from monomers such as vinylchloride, ethylene, propylene, butylene, styrene, butadiene, methylmethacrylate, vinyl fluoride, and mixtures thereof. Composite systems may also be used such as E-glass fibers, glass fibers, boron fibers, high-strength graphite fibers, high modulus graphite fiber, and mixtures thereof all within the supporting polymeric matrix. Useful polymeric matrices include any of those provided above in addition to those thermoset or thermoplastic matrices known to those with skill in the art such as epoxies, urethanes, vinyls, alkylesters, acrylics, and hybrids thereof.

Various high strength light-weight metals may also be used such as metals and the metal alloys of aluminum, titanium, nickel, copper, magnesium, manganese, iron, and mixtures thereof. Preferably, the seating system of the invention is made of polyvinyl chloride available from Allen Co. of Minnesota as Vintec® a high impact Type 2 polyvinylchloride. Any material used should have easy moldability and machinability. The use of this material, especially in the seat back, allows for the individual to be monitored through means such as an x-ray and the like without removal from the seat.

As noted, the claimed invention generally comprises a seat 10 and a stand 70, FIG. 2. In accordance with a preferred embodiment, the seat has a base 12 which provides support for the weight and mass of the user as well as providing a structural support for joining the other elements of the seating system such as side panels 14 and 16 or various straps and restraints. For example, as can be seen in FIG. 2, the base 12 generally has any number of slots 18 for accepting straps, cords, and the like which will allow for the support of an individual who may be positioned within the seat 10 as well as retaining the seat 10 in stand 70.

Additionally, the base 12 may have affixed thereto base side panels 14 and 16. The base side panels serve to provide additional support to the individuals sitting within the seating system as well as increasing the structural integrity of the seating system.

Additionally, base side panels 14 and 16 of different dimension may be used to obtain the desired effect in use. Specifically, a base side panel is used which keeps the users hips in neutral position. To this end, the base side panels may prevent the users hips from becoming splayed or abducted, a condition which may lead to hip dislocation. In the meantime, the base side panels may be used in conjunction with pommel 40 to either abduct or adduct the hips, thereby providing a truly neutral position.

A seat back 22 may be attached either to the base side panels 14 and 16 or the seat base 12. Here again, the seat back 22 is intended to provide support and comfort to the user. To this end, the seat back 22 may also comprise a number of elements including seat back extension 23 and head rest 25. Seat back extension 23 allows for the seating system of the invention to be enlarged in the vertical direction, thereby allowing for growth of the individual through the waist, torso, and thoracic regions of the body. In turn, head rest 25 allows for the user to have the necessary head and neck support as provided by the seating system of the invention. In younger users or users of smaller size, headrest 25 may be completely unnecessary. Further, in certain circumstances, head rest 25 may be selectively removed to assist in the strengthening of upper chest and neck muscles. Accordingly, the modular nature of the invention, allows for the seating system to be used for support as well as therapy given the selective needs of the individual user.

Generally, the seat back 22 may be adjustable so as to allow the seat back to be positioned at any number of angles between 0 and 90 degrees from horizontal.

Here again, this allows the hips and spine of the user to be placed in that position most close to neutral by creating hip flexion. Preferably, the seat back may be pivoted as much or more than about 20° from vertical (90°). As can be seen in FIG. 2, a series of openings 29 may be used to allow for the angled adjustment of the seat back 22. These openings 29 correspond to a complementary opening in seat back side wings or flange 27 through which means such as a screw, bolt, or pin may be inserted.

Generally, the seat back 22 is positioned at an angle less than 90 degrees from horizontal and is affixed to the base side panels 14 and 16. In its most preferred mode, the seat back 22 is fixed to the base side panels 14 and 16 in a manner which will allow the seat back 22 to rock or pivot in relationship to the seat base 12. This action may be provided for through the use of permanent and removable attachment means between the seat back 22 and the base side panels 14 and 16 through the openings at 29. For example, seat back edge 21 and 23 may be affixed at corresponding points to be attached permanently to base side panel 14 and 16 respectively by screws or bolts. Additionally, seat back edges 21 and 23 may also be drilled to have holes or openings which correspond to holes or openings on base side panels 14 and 16. These corresponding holes will allow for the adjustment of the angle of seat back 22 by removing the pins and manipulating the seat back to the desired angle as measured substantially by the pattern of opening at 29. The seat back 22, back extension will also preferably have any number of assists such as a carry handle 21 found in seat back 22, FIG. 2.

In its most preferred mode, the seat back also comprises opposing thoracic supports 24 and 26, FIG. 1. Thoracic supports 24 and 26 function to hold the users upper body in neutral alignment thereby avoiding the creation of a scoliotic curvature in the user's spine. Preferably, supports 24 and 26 are adjusted to obtain a high purchase of support into thoracic area, close underneath the user's arm pits. To this end the thoracic supports may take any configuration which is consistent with these functions.

Figure 3A:
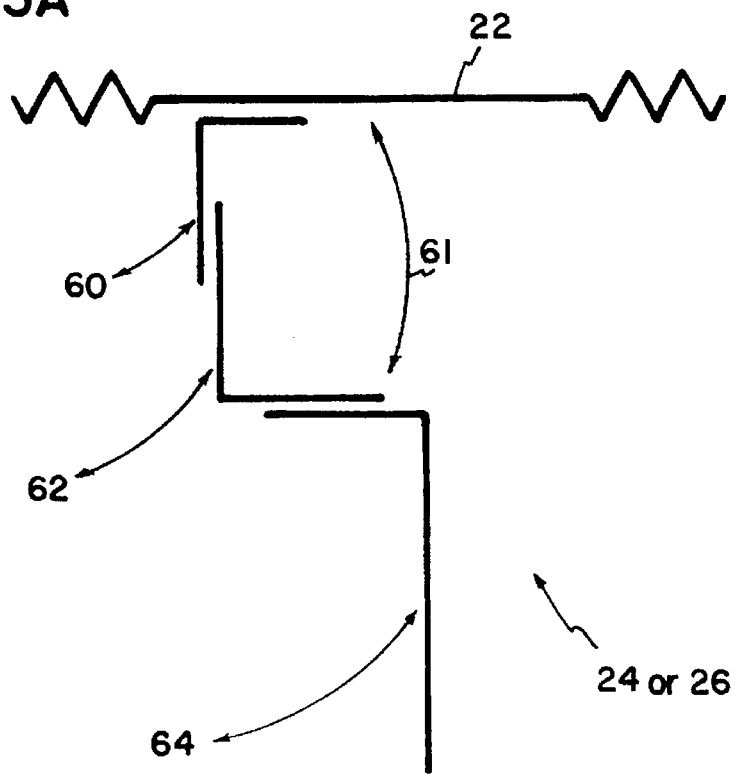
FIGS. 3A and 3B are top plan views of thoracic supports used in accordance with one embodiment of the invention.

Preferably, the thoracic supports have a configuration such as that shown in FIG. 3A. As can be seen, support piece 60 attaches to seat back 22 through any number of means such as screws, bolts, or pins (not shown). The thoracic supports may be coated or cushion lined with any number of substances such as those used for the cushion system of the invention. Support piece 62 may then be attached to support piece 60 to extend the thoracic support 24 or 26 away from the seat back 22 and form opening 61. Along with other mechanisms such as adhesives and VELCRO, space 61 server to hold cushion 54 in place between the user and the seat back 22. Support piece 64 functions as the active support of the thoracic cavity extending from the seat back 22 to provide contact with the user. Consistent with the modular nature of the invention, support piece 64 may be reversed to allow added growth area for the user. The thoracic supports may be designed or manufactured to allow attachment of a shoulder and chest harnesses. Such a harness may be run from the back side of seat back 22 over the vertical top of the seating system to fasteners on the thoracic supports. The seating system of the invention may also have any number of belts such as lap belt 35 for containing the user.

As can be seen, the thoracic supports may additionally be adjustable to move on the seat back either vertically or horizontally to afford adjustability to the user. As can be seen in FIG. 2, adjustment may be made through either vertical or lateral adjustment between corresponding openings in the thoracic support and the set back through the use of various means such as screws or bolts. Additionally, thoracic support 24 and 26 may be sized so as to provide for individuals of varying height and shape with the understanding that the length and depth of individuals thoracic cavities may not always be the same.

In accordance with the modular and adjustable nature of the invention, the back extension 23 and head support 25 may be fitted to the seat back through a track and edge or rail system. As seen in FIG. 2, seat back 22 has thickened side wings 27. The side wings 27 assist in positioning the cushions or bolsters used with the seating system. The side wings 27 also define a track 32 on either side of the seat back 22 at the axis defined by the side wing 27 and seat back 22. The side wings may be designed or otherwise manufactured to a greater thickness to provide the requisite structural integrity to each track 32. Seat back extension 23 may then be slid into the tracks created on each side of the seat back 22 and secured to the seat back through the use of screws, bolts, or pins. By the creation of a vertical row of holes 34 on each side of the seat back 22 and seat back extension 23, it is possible to provide a series of settings which allow for the vertical extension of the seat back. Any number of spacing elements (not shown) may be placed over the exposed edge of the seat back extension through the same track and edge mechanism.

Further, as can also be seen in FIG. 2, the head rest 25 can be attached to the seat back extension 23 through the track 33 formed between the head rest 25 and head rest wing 30. This track and edge mechanism allows the continued growth of the seat system of the invention to allow for the needs of the user.

The invention also comprises a base extension 42. The base extension allows for extension of the length of the base so that the seating system can actually "grow" with the user. Any number of variations on the base extension 42 may be possible in accordance with the invention.

In a preferred mode, the base extension comprises a platform which may be slidably fitted into the seat base 12. As seen in FIG. 4, base extension 42 has rail on each side 41. Each of the rails 41 combined with the base extension 42 provides for edges 43 which extend and run beyond the width of the base extension 42 and rail 41. These edges allow for the slidable fitting of the base extension 42 into the seat base 12 along the track 13, (FIG. 2), positioned on either side of the base underneath said base side panels 14 and 16.

As with the seat back 22, the seat base 12 may be extended with a track and edge mechanisms to "grow" the dimension of the seat base. As can be seen in FIG. 2, seat base 12 may be designed with seat bare wings 15 and 17. On each side of the seat base 12, a track 13 is found at the axis between the seat base 12 and the seat base wings 15 and 17.

In use, the edges 43 on each side of the seat base extension 42 may be slid into the track 13 of the seat base 12. The seat base extension 42 may then be locked in place by the insertion of screw, bolt, or pin 11 through a hole 19 (FIG. 1) at the front of the seat base into the selected slot 42 in the seat base extension, (FIG. 4).

Extension elements may also be added to the seat base extension 42 to allow for users who have problems such as femur bones of different length which results from problems such as hip dislocation. For example, an extension plate may be added at the front area 35 of the base extension 42 to allow selectively for a longer right femur bone in a user. The base extension may also be provided without front area 35 or arms 44. Configuring the base extension 42 without arms 44 or front area 35 allows the seat 10 to be used in various recreational activities where it may be laid flat on a pre-existing seat in a boat, car, or any other type of vehicle or environment. The seat 10 may be designed with varying widths to allow for placement in various other types of seating arrangements such as a high chair.

The slots 45 may be designed to correspond with openings (for example, 19, FIG. 1) configured within the seat base 12 or base side panels 14 and 16 allowing for the insertion and removal of mechanisms such as pins 11 and the like. In operation, the base extension may be slid into the seat base 12 through the corresponding edges 43 and tracks 13 in order to increase or decrease the depth of the base 12 while the user is seated in the system. Removable pins may be inserted through the openings on the seat base which are aligned with the slots in the base extension. This allows for the adjustment of the base extension within the seat base.

The seating system also preferably comprises a hip abduction pommel 40, FIGS. 1 and 2. Among other functions, the pommel 40 holds the legs apart and in turn, abducts the hips of the user into a neutral position thereby preserving the appropriate posture and allowing for normal hip development. The pommel may be attached directly to the seat base 12 or to the seat base extension 42. One preferred configuration, is to attach the pommel 40 to the seat base extension 42 at the base extension front area 35, FIGS. 1 and 2. As can be seen, pommel 40 is attached by rod 39 which is inserted through bracket 37. This allows for the unitary movement of the pommel 40 with the seat base extension 42, while also allowing the pommel 40 to be easily removed to allow exit of the seating system.

Additionally, the invention also comprises a foot support 46, (FIG. 2). The foot support may take any number of configurations in accordance with its function of providing support to the lower legs of the user. Further, the foot support 46 may be attached to the stand 70, seat base 12 or seat base extension 42. The foot support may comprise one unitary platform or independent platforms as seen in FIGS. 1, 2, and 4. The use of two independent platforms allows for the addition of spacers (not shown) above support 49 affixed under the selected foot support 46 (FIG. 4) to raise the height of that support thereby allowing for disparate bone length in the lower leg region. The foot support 46 of the invention may also be used with foot sockets and instep straps to prevent rotation.

In one preferred mode the foot support 46 may be attached to the base extension through the same edge and track mechanism used with the seat back 22 and seat base 12. The foot support of the invention may be attached to the base extension 42 through arms 44. As can be seen, the foot support may additionally comprise foot support arms 47 which may be machined, or designed to have holes which correspond to those holes configured in arms 44. Accordingly, the foot support may be adjusted to provide for any varying length in the lower leg portion of the individual user. Through the same means used to adjust the seat back 22 and seat base 12. As can be seen, a track is defined at the axis between the arm 44 and arm backing 45, FIGS. 1 and 4. In turn, holes and fasteners 48 may be used to adjust the relative height of the foot support arms 47.

The seating system of the invention also includes a number of modular cushions. The cushions used in the seating system of the invention function to provide comfort as well as assisting in the therapeutic positioning of the occupant by even distribution of weight.

All pads, cushions or bolsters used in accordance with the invention have the ability to be flat or contoured and may be affixed to the seating system of the invention through the use of means such as the self-adherent nature of the vinyl coating applied over the polymeric cushion, double-stick tape, VELCRO 51, or other means. The cushions which are used and the invention generally fall into five areas. A cushioned headrest is provided in any number of designs or contours to allow for occipital support. In the chest area, cushions are provided to support the thoracic cavity as well as the torso. A cushion may be applied to seat back 22 to provide support and assist in posturing the pelvic area to promote trunk extension. Further, side panel cushions may be used to promote proper lateral spinal posture and prevent scoliotic curvature of the spine. Finally, the seat base 22 may be cushioned to prevent kyphotic curvatures of the spine.

Generally, the entire seating system is cushion lined including the seat base 22, seat side panels 14 and 16, seat back 22, back extension 23 and head rest 25. The cushions or bolsters used in the invention may be composed of any number of polymeric foams. The preferred foam comprises nitrile butadiene rubber polyvinyl chloride foam which is made by Monarch Rubber Co. and distributed by Amcom Co. of Minnesota. We have also found that coating the foam cushions provides water proofing. With the preferred coating, the cushions retain a self-adherent, tacky character. While any number of coatings may be used, F701B polyvinyl chloride paint distributed by PlastiDip Inc. of Minnesota is preferred.

The cushions used in the invention may be covered with any number of materials which promote added comfort and support including providing qualities of water proofing and promoting sanitization and cleaning. One preferred cover has been shown to be made up of rubber sold as neoprene rubber Rubatex® by the Rubatex® Corporation of Bedford, Va. The advantage of using a neoprene rubber cover for the cushions and thoracic supports of the invention is that its cover stretches and allows the cushions to be increased and added to as the device has in fact increased in size.

As the seat of the invention is initially configured, there is more than room for the seat to "grow" through back extension 23, seat base extension 22 and reduction of the side panel cushions 50. Preferably, the seat of the invention comprises cushions or bolsters covered by a neoprene rubber slip cover. This slip cover may be oversized to allow for the addition of cushions such as head rest cushion 60, back cushions 56 and 58, or added seat base extension cushions. As cushions are added the slip cover may be selectively enlarged by means such as clip 53, FIG. 6. In use, the excess material from the seat cover may be inserted through the opening 59 (FIG. 2) between the seat base 12 and seat back 22. In turn, this material may inserted into the clip 53 through slot 55 so that the full lateral breadth of the material rests in opening 57. The excess material may then be collected by winding clip 53 and securing it in place adjacent seat back 12 by means such as screws, bolts, or fastening plate.

Generally, the seat base contains a base cushion 52. Generally, the base cushion functions to allow for the comforts and support of the user through distribution of weight. In its most preferred mode, the base cushion has a front area and a rear area as can be seen in FIG. 2. The front area is preferably elevated above the plane of the rear area, the elevation defined by a ledge between the two areas. This provides for additional pelvic support and the prevention of spinal curvature created by the use of the seating system over long periods of time.

The ledged base cushion supports the pelvis and spine reducing the occurrence of posterior pelvic tilt which, in turn, can result in kyphotic spinal posture, also called lumbar kyphosis. Preferably the front section of the base cushion is composed of a crosslinked ethylene vinyl acetate foam having a density of about 0.032 $gm/cm^3$ to 0.048 $gm/cm^3$ with the foam in the rear area of the base cushion composed of nitrile butadiene rubber/polyvinyl chloride foam having a density of about 0.064 $gm/cm^3$ to 0.192 $gm/cm^3$. Preferably, the ledge between the front and rear areas of the base cushion 52 has a vertical height ranging from about 4 to 6.5 cms.

Figure 5:
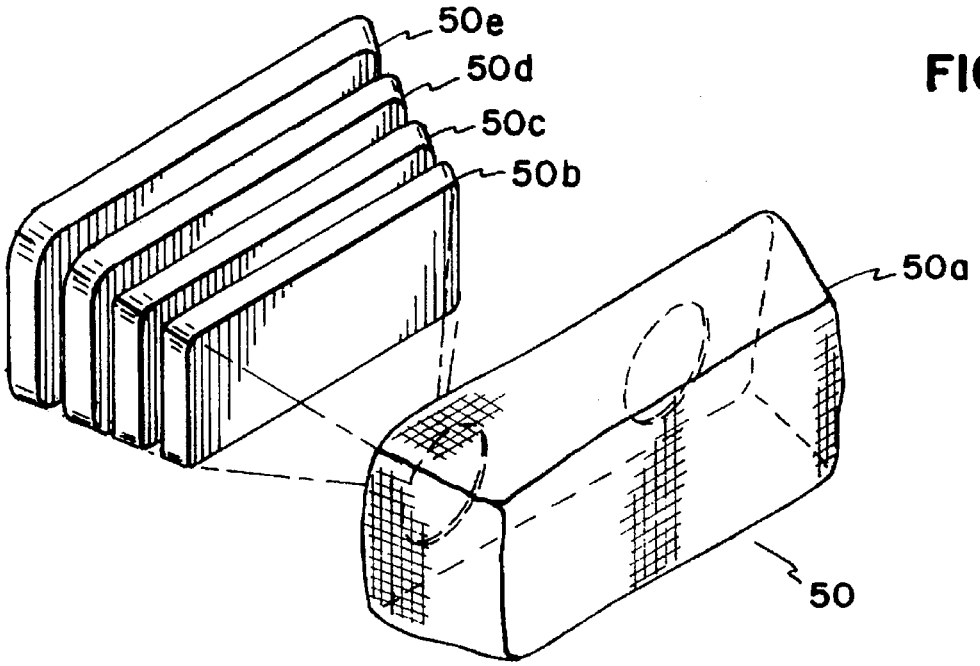
FIG. 5 is an exploded inverted perspective view of a seat base extension in accordance with embodiment of the invention.

Additionally, the seating system of the invention may have side panel cushions 50, FIGS. 2 and 5. Side panel cushions 50 function to center the pelvic region of the user's body in the lateral dimension. That is, these cushions may be used to increase or decrease the lateral area in which the pelvis rests or is contained thereby promoting the application of equal weight on both ischial tuberosities bones in the user's pelvic area. In turn, this prevents the spine from adopting a scoliotic curve which may have otherwise occurred to correct the position of the user's head. In effect, it is thought that by creating a level pelvis the spinal posture is straight.

Figure 3B:
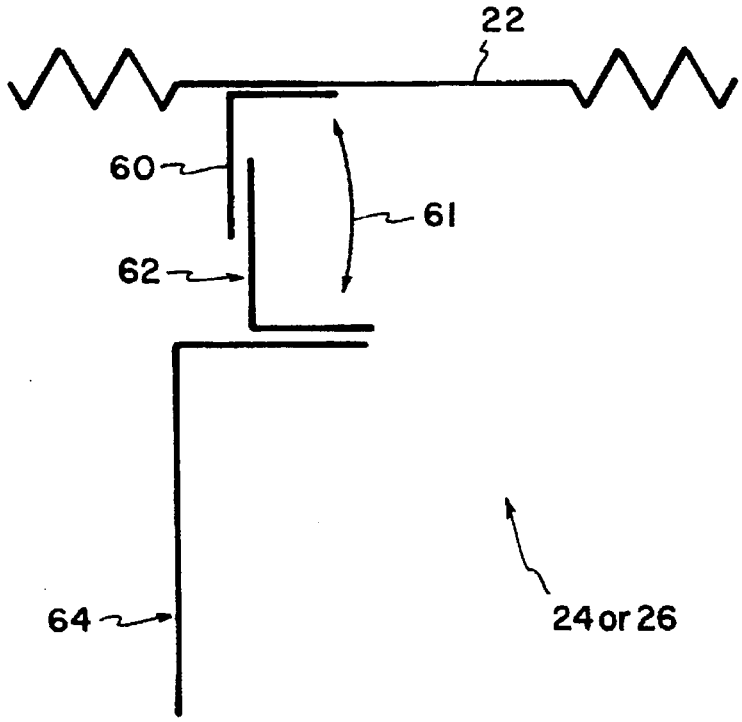

As can be seen, the side panel cushions attached to the base side panels 14 and 16. The side panel cushions 50 function to contain the lower body, that is buttocks and thighs of the user. In order to provide adjustability, the side panel cushions may be stepped or layered as can be seen in FIG. 5. In this instance, the side panel cushion 50 may preferably comprises a stretchable over liner 50A which may be fitted over various cushion layers 50B–50E, FIG. 3.

In operation, adjustment can be attained with the removal of side panel cushion 50 from the side panel and the stretch removal of cushion layers 50B–50E from the cushion over liner 50A. Various layers of cushioning may then be peeled or otherwise removed from the layering of cushions to provide the desired comfort and fit within the seating system of the invention. Once the appropriate number of cushioning layers has been determined, they may be inserted back into the over liner 50 and reapplied to base side panel 14 or 16. Accordingly, the seating system of the invention provides this additional level of adjustability. The seat back additionally provides for any number of cushions. As can be seen, back cushion 54 may generally be slotted through the torso supports into a position in the lower back 22 of the seating system of the invention. The design of the torso supports allows for containment of this cushion and the positioning of the cushion overall. Additionally, the seating system of the invention provides for midback cushions 56 and 58 which may be used in younger children to actually support the child's head and in older children to provide support to the middle back.

In order to cushion the back extension 34, a back extension cushion 36 may be added. As with all the cushions provided in the invention, they may attached to the structure of the invention to any means known to those with skill in the art such as for example, VELCRO, 2 sided tape, etc. keeping in mind the advantage of the invention is the provision of an adjustable seating system.

Seating system of the invention also comprises a stand 70, FIG. 2. The stand of the seating system of the invention allows the seat to go from an angle of 90 degrees or vertical to less than 90 degrees. This is advantageous for people who cannot sit at 90 degrees for long periods of time due to lack of head control, lack of tone in their torso or trunk muscles, swallowing problems, and overall comfort. Additionally, the user of the seating system of the invention may have conditions of insensate skin where it is necessary to keep weight from regions of the body that might normally be subject to weight or support as an individual is sitting.

In its most preferred mode, the stand used in the seating system of the invention has a positive lock on the rocker mechanism. A positive lock allows for a stand which is secure and which may also allow the user to sit at the same height as those sitting in normal chairs or stools. This is especially important for allowing the interaction of disabled children in normal or routine daily activities.

The use of the positive lock on the rocker mechanism combined with the strapping system between the thoracic supports 24 and 26 and seat back 22 may also allow individuals to sit hands-free. For example, it is often the case that individuals having cerebral palsy need to use their hands to balance. The seating system of the invention makes this expenditure of physical effort generally unnecessary.

The stand used with the seating system of the invention may also be made mobile through the addition of casters and push handles to allow for the seating system to become a self-sustained, self-contained unit. This allows the seating system to be drawn into any number of environments for the seat to be used in recreational activity such as on playground equipment, athletic equipment, and the like. Additionally, this seat used in the seating system of the invention may be drawn into stands of any number of varying heights to allow for the full interaction of the individual.

The stand is made up of a cradle 72 including a cradle seat 74 and a cradle back 76. The cradle seat 74 cradle back 76 may be designed or configured to have any number of openings or entry points such as slots 73 for the belted attachment of the seat 10 to the stand 70. The seat may additionally comprise any number of belts, and straps, such as buckle 71 which may be attached to a corresponding strap (not shown) from seat 10 for attachment at the front of the seating system. Generally, the stand 70 may have any number of means which allow for the additional portability of the stands such as brackets which may be used for the acceptance of caster wheels.

Figure 6:
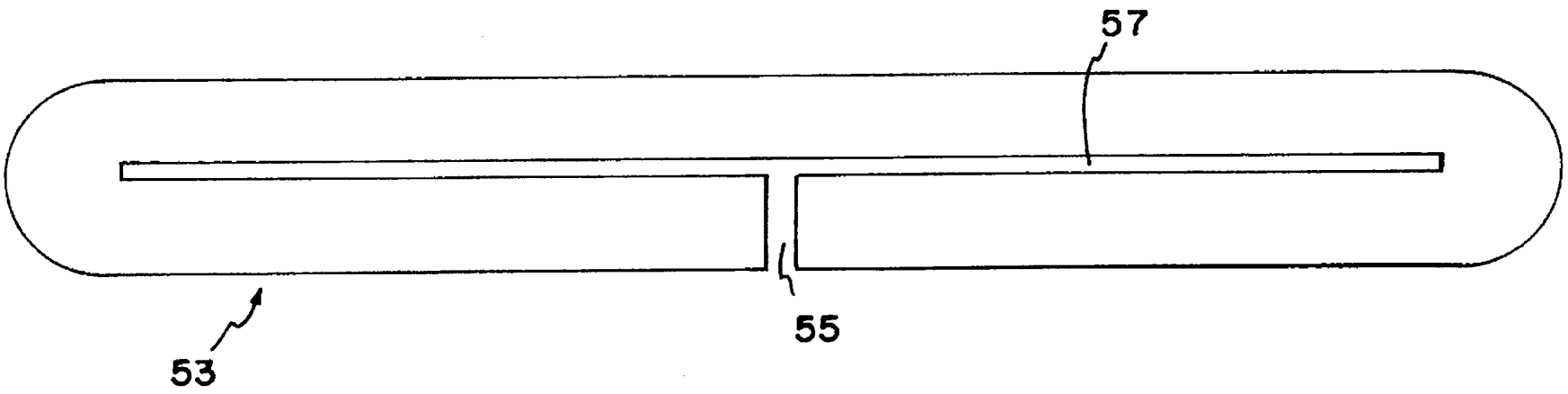
FIG. 6 is a top plan view of a cloth retaining clip in accordance with one embodiment of the invention.
Figure 7:
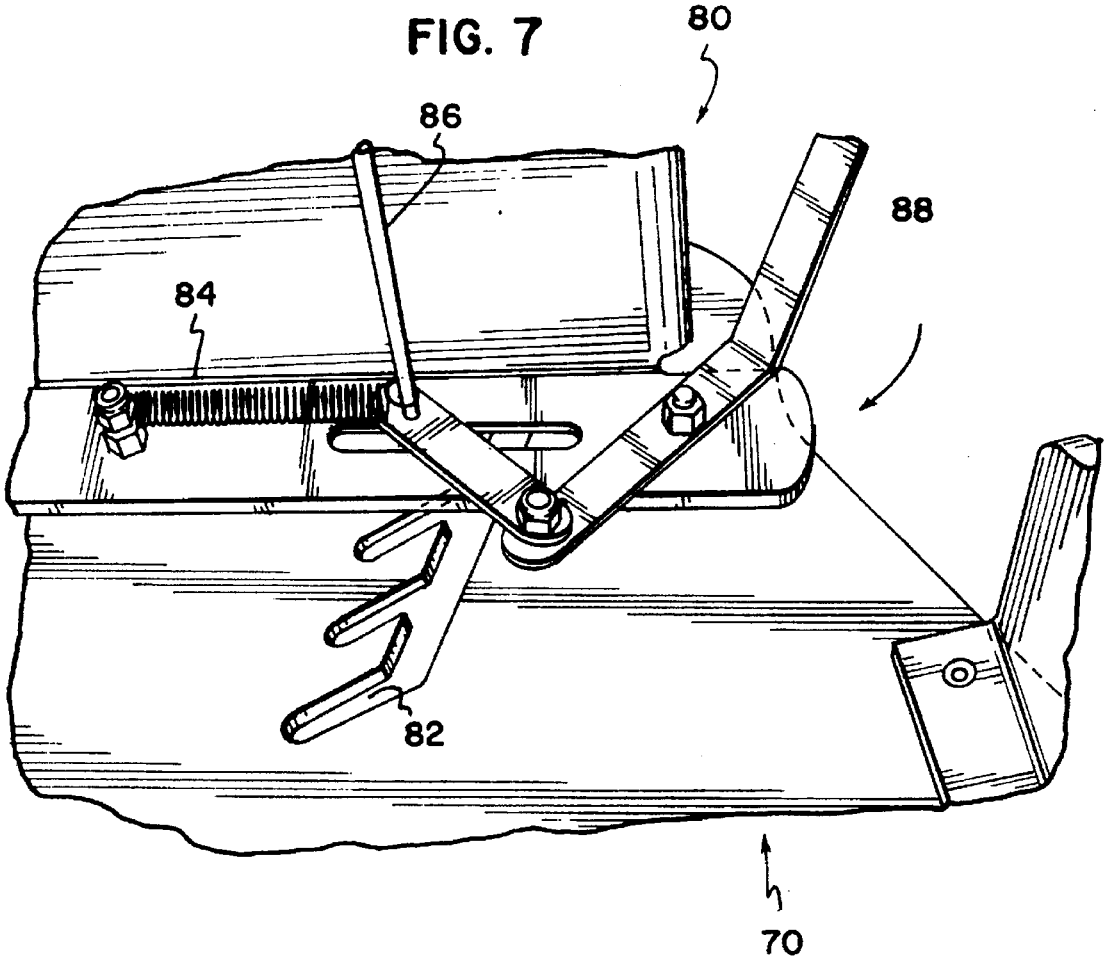
FIG. 7 is a partial cut-away view of the adjustment mechanism in a stand in accordance with one embodiment of the invention.

In its preferred mode, the cradle rocks or tilts back within the stand 70 as can be seen in FIG. 6, the cradle may comprise a rocker mechanism 80 including a rocker bar 88 a rocker pin 86 and a rocker spring 84. In operation, rocker bar 86 is moved forward pulling back rocker pin 86 which allows this pin to move with an opening 82. When the desired angle of the cradle is reached, rocker bar 86 may be released at which time spring 84 pulls rocker pin 86 back into the desired slot with an opening 82. This allows the seating system of the invention to be angled to aid in the comfort of the user. Such angling may be appropriate for sleeping, feeding, or other types of activity in order to simulate or otherwise compliment routine or daily activities undertaken by the user.

The above discussion, Examples and data illustrate our current understanding of the invention. However, since many variations of the invention can be made without departing from the spirit and scope of the invention, the invention resides wholly in the claims hereinafter appended.

We claim:

1. An adjustable seat, said seat comprising:

(a) a base having first and second sides, said base comprising a first side panel and a second side panel attached to said respective base first and second sides, each of said first and second side panels having an opening and comprising a cushion lining;

(b) a back, said seat back positioned adjacent said seat base, said seat back comprising first and second opposing thoracic supports;

(c) a base extension, said base extension having first and second sides, each of said base extension first and second sides having a series of slots;

(d) a foot support attached to said base extension; and (e) a stand, said stand comprising a cradle, wherein said cradle is adjustable and configured to accept said seat back and base;

wherein each of said base first and second side has at least one opening, said base extension comprising first and second sides, each of said base extension first and second sides having a series of at least two slots, said seat comprising first and second pins, whereby said base extension may be attached to said seat base by aligning said seat base openings and said base extension slots and inserting said first and second pins through said openings into said slots.

2. The seat of claim 1 wherein said seat back has a first side edge and a second side edge, said first thoracic support positioned adjacent said seat back first side edge and said second thoracic support positioned adjacent said seat back second side edge.

3. The seat of claim 1, wherein said seat comprises a back extension releasably attached to said seat back.

4. The seat of claim 1 wherein said side panel cushion lining comprises a first and second cushions positioned on said first and second side panels respectively, said first and second side panel cushions each comprising a series of stackable cushion wafers and an enclosing web.

5. The seat of claim 1, wherein said cushion lining comprising first and second cushions positioned on said first and second side panels, respectively, each of said first and second side panels comprising a series of stackable cushion wafers enclosed within a stretchable overliner.

6. The seat of claim 5, wherein each of said stackable cushion wafers is coated with polyvinyl chloride paint.

7. The seat of claim 1, wherein said base comprises front and rear areas wherein said base front area has a greater relative height than said base rear area when said base is positioned on a horizontal plane.

8. The seat of claim 7, wherein said seat back and seat base are cushion lined.

9. The seat of claim 8 wherein said seat base cushion has a front portion and a rear portion, said seat cushion front portion having a greater thickness than said seat cushion rear portion.

10. The seat of claim 8, wherein said cushion lining is coated with polyvinyl chloride paint.

11. An adjustable seat, said seat comprising a base having first and second sides and comprising first and second side panels, a back positioned adjacent said seat base, a base extension having first and second sides each side having a series of slots, a foot support positioned adjacent said base, and a stand comprising a cradle configured to accept said seat base, said seat comprising first and second cushions positioned on said first and second respective side panels, each of said first and second cushions comprising stackable cushions enclosed within a stretchable overliner.

12. The seat of claim 11, wherein said seat comprises a seat back, base, and side panels are cushion lined.

13. The seat of claim 11 wherein said seat comprises a seat base cushion has a front portion and a rear portion, said seat cushion front portion having a greater thickness than said seat cushion rear portion.

14. The seat claim 11 wherein said seat back comprises a first thoracic support and a second thoracic support said first and second thoracic supports positioned in opposition to each other on said seat back.

15. The seat of claim 11, wherein said seat comprises a back extension releasably attached to said seat back.

16. The seat of claim 11, wherein said cushions are coated with a polyvinyl chloride paint.

* * * * *